US005953363A

United States Patent [19]

Cao

[11] Patent Number: 5,953,363

[45] Date of Patent: Sep. 14, 1999

[54] BUSHING FOR MINIMIZING POWER LOSSES IN A CHANNEL INDUCTOR

[75] Inventor: Maochang Cao, Warren, Ohio

[73] Assignee: Ajax Magnethermic Corporation, Warren, Ohio

[21] Appl. No.: 08/814,421

[22] Filed: Mar. 10, 1997

[51] Int. Cl.[6] ..... H05B 6/20

[52] U.S. Cl. ..... 373/161; 373/164

[58] Field of Search ..... 373/147, 148, 373/149, 150, 159–165; 219/672, 676

[56] References Cited

U.S. PATENT DOCUMENTS

| | | |
|---|---|---|
| 3,320,348 | 5/1967 | Seulen et al. . |
| 3,775,091 | 11/1973 | Cites et al. . |
| 4,021,602 | 5/1977 | Delassis . |
| 5,222,097 | 6/1993 | Powell et al. . |
| 5,257,281 | 10/1993 | Cignetti et al. . |
| 5,272,720 | 12/1993 | Cignetti et al. . |

*Primary Examiner*—Tu Ba Hoang

*Attorney, Agent, or Firm*—Fay, Sharpe, Beall, Fagan, Minnich & McKee

[57] ABSTRACT

A channel furnace for the inductive heating of metal includes a molten metal holding hearth and a core and coil assembly surrounded by a channel of the furnace for inducing heating current in the metal in the channel. The channel is separated from the core and coil assembly by a refractory insulator and a bushing interposed between the refractory insulator and the core and coil assembly. The bushing is comprised of a wall portion having a plurality of slits or gaps disposed in the wall for minimizing eddy current formation therein and correspondingly reducing power loss therefrom. The bushing can be configured as either a coil type comprised of a plurality of slits disposed to extend circumferentially or a cage type, wherein the slits are disposed to extend longitudinally for segregating the wall into a plurality of wall sections. Both types can be made of water cooled flat metal tubes instead of plates with slits.

24 Claims, 7 Drawing Sheets

BUSHING FOR MINIMIZING POWER LOSSES IN A CHANNEL INDUCTOR

BACKGROUND OF THE INVENTION

The invention relates to the field of induction heating, and more particularly to channel furnaces. Channel furnaces typically include an induction heater spaced by a metallic bushing from a refractory material defining the channel of the channel furnace. The construction and configuration of the metallic bushing in a manner to reduce power losses due to eddy currents is the particular subject of the invention, however the invention can be appreciated for use in other environments where it is desired to minimize power losses attributable to leakage fluxes.

Channel induction furnaces are well known for heating an electrically conductive material, such as a metal like aluminum, where the metal is disposed to form a metal loop around a coil and core assembly in a manner to essentially function as a single turn secondary winding thereof. When power is applied to the coil, a magnetic flux is generated into a laminated iron core and a voltage and current are induced in the metal loop. The molten metal in the loop defined by the channel of the furnace is retained and spaced from the coil by a refractory lining. A bushing is interposed between the core and coil assembly and the refractory to space the refractory from the coil. The bushing is often water cooled to enhance its ability to protect the coil from the heat of the furnace. It is well known that to prevent the bushing from acting as a short-circuited secondary winding, the bushing will include a gap or slit disposed along the entire longitudinal length of the bushing. However, such prior known bushing configurations have suffered from problems of undesirable power losses, not from the main flux of the core, but from the channel current flux and the leakage flux of the coil.

The magnetic fluxes in a conventional channel inductor are as shown in FIG. 2. The main flux 50 in the core does not generate any current in the bushing 40 since it is slit along its length by a gap 42 (shown in FIG. 3), but the leakage field 52 and channel current flux 54 do. For analysis purpose, the leakage field will be discussed as being divided into an axial component and a radial component.

The axial component refers to the longitudinal flux 56 parallel to the bushing. It comprises contributions from both the coil 18 and the channel 22. This component induces a current 58 which circulates within the bushing thickness (see FIG. 3). Hereafter this current will be referred to as the "layer current".

On the other hand, the radial component refers to the transverse flux 60 (FIG. 4) penetrating through the bushing 40. This flux is mainly generated by the channel current $I_2$. It induces the double-loop current pattern 62 in the bushing plate. Hereafter this current will be referred to as the "plate current".

Without changing the existing bushing configuration, the only parameters that can be adjusted to minimize eddy current power losses are bushing thickness and resistivity.

Considering the base relationship, $P=I^2R$, the best way to minimize power loss (P) is to reduce the eddy current (I). If reducing the current is difficult, then the only way left is to reduce the resistance (R).

It is very easy to reduce the layer current 58 of FIG. 3, i.e., reduce the bushing thickness and/or increase the resistivity. When the thickness is smaller than half of a penetration depth, the power loss will be negligible due to cancellation between the opposite currents.

Penetration depth is defined by the equation:

$$d_2 = 3160\sqrt{\frac{\pi}{\mu f}}$$

where: $d_2$ = penetration depth
$\rho$ = resistivity
$\mu$ = relative permeability
$f$ = frequency It is, however, very difficult to minimize the plate current 62 of FIG. 4, since the impedance of such a big loop is inductance dominant. Reducing thickness and/or increasing resistivity has little influence on plate current without going to extremes. For example, it takes a stainless steel bushing of thinner than 0.098 of an inch to reduce the current and the power loss. Such a thin bushing may create mechanical and heat conduction problems. Considering the difficulty in reducing current, the practical method in this case is to reduce the resistance. This means that a good conductor such as copper with a sufficient thickness could be used.

Since the optimization requirements in the above two cases are contradictory, there exists an optimum thickness for a given material. For copper, the optimum thickness of a typical bushing is around 0.39 inch. Further increase in thickness will cause the layer current and hence the total power loss to increase; any further decrease in thickness will cause the resistance of the plate current loop and hence the total power loss to increase.

The above analysis shows that the ability to achieve a reduction in bushing losses is limited mainly because it is so difficult to reduce the plate current. To do so, it is necessary to cut off the current path. This can only be achieved by breaking up the solid bushing.

The subject invention overcomes the problems of prior known bushing configurations to provide a plurality of new bushing configurations, all of which reduce power losses while providing a suitable separation and protection of the coil and core assembly from the refractory lining.

BRIEF SUMMARY OF THE INVENTION

In accordance with the present invention, there is provided a bushing for an induction coil in a channel induction furnace particularly suited for minimizing power losses due to eddy currents in the bushing caused by channel current and coil leakage fluxes. The new bushing is generally comprised of a wall configured to insulate a coil and core assembly of the furnace from a refractory material defining a wall portion of the channel in the channel furnace. The bushing wall has a gap extending a longitudinal extent thereof to preclude the bushing from functioning as a shorted secondary winding to the core and coil assembly. The bushing further includes a plurality of slits disposed in the wall for minimizing eddy current formation therein. Power loss is reduced since currents are forced to circulate within each strip and opposite currents therein will cancel each other. For air-cooled, low power rating inductors, the bushing comprises a cylindrical plate wherein the slits, although extending across a major portion of the bushing, do not have to be cut through at both ends to break the current loop. For water-cooled, high power inductors, tubes are used in place of the strips to allow water cooling of the bushing.

In accordance with another aspect of the present invention, the slits are disposed to extend circumferentially for segregating the bushing wall into a plurality of wall sections, thereby forming a bushing comprising a coil bushing.

In accordance with another aspect of the current invention, the slits are disposed to extend longitudinally for segregating the wall of the bushing into a plurality of wall sections, thereby forming a bushing comprising a cage bushing.

One benefit obtained by use of the present invention is a bushing for a channel furnace which adequately protects and insulates the core and coil assembly from the heated refractory disposed about the bushing, but exhibits substantial improvements in power loss reduction over prior known bushing configurations.

Another benefit obtained from the present invention is a bushing configuration which can be disposed as either a cage busing, coil bushing, or comprising either a tube or flat plate, but whichever configuration is adopted all exhibit improved reduction in power losses.

Other benefits and advantages for the subject new channel furnace and bushing for an induction coil in the channel furnace will become apparent to those skilled in the art upon a reading and understanding of this specification.

BRIEF DESCRIPTION OF THE DRAWINGS

The invention may take physical form in certain parts and arrangements of parts, the preferred embodiments of which will be described in detail in this specification and illustrated in the accompanying drawings which form a part hereof and wherein.

DETAILED DESCRIPTION OF THE PREFERRED EMBODIMENTS OF THE INVENTION

Figure 1:
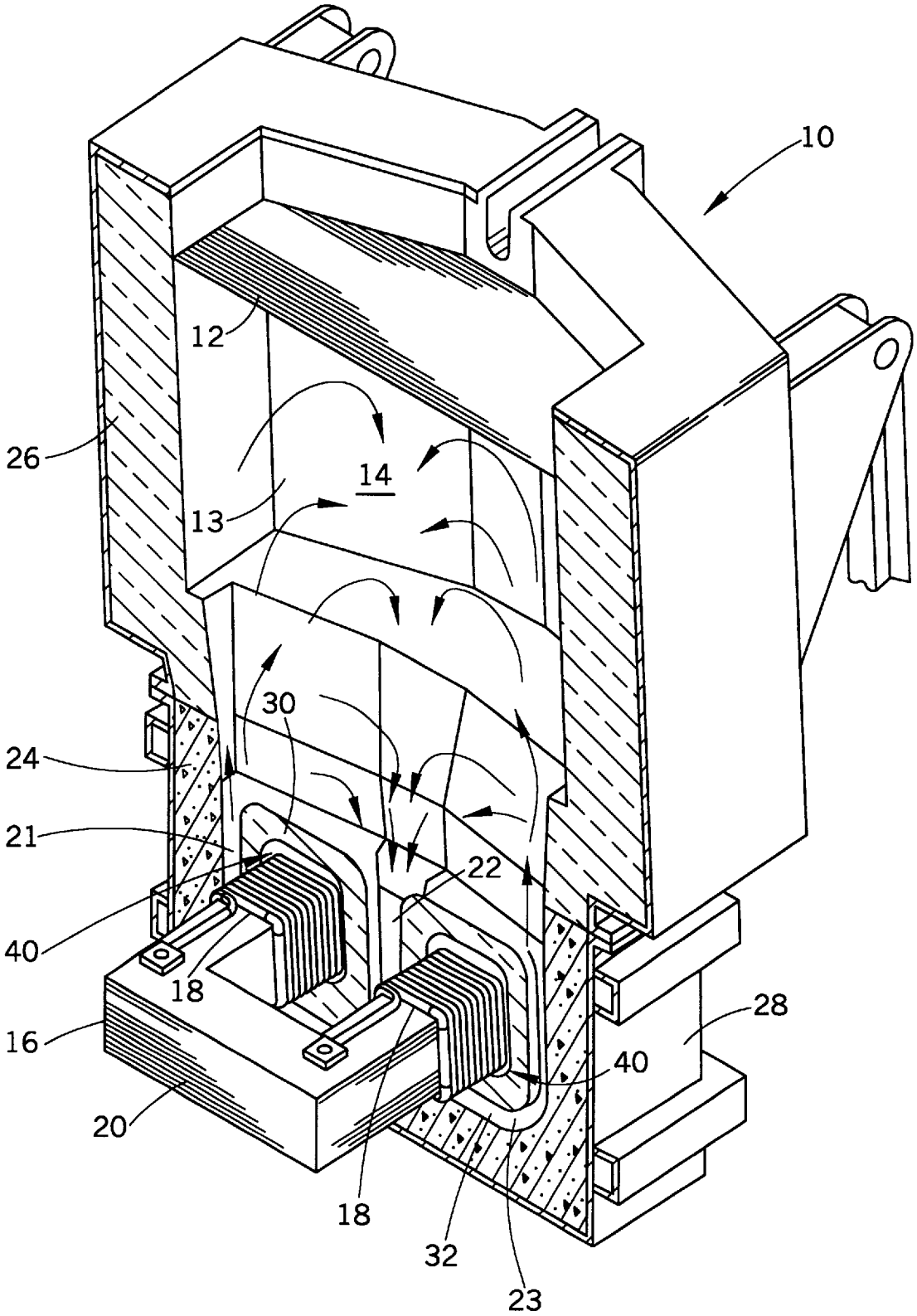
FIG. 1 (PRIOR ART)
FIG. 1 is a perspective view, partly in vertical cross-section, showing the general structure of a channel furnace having a channel for molten metal disposed about the core and coil assembly, wherein a bushing configured in accordance with the present invention can be employed.
Figure 2:
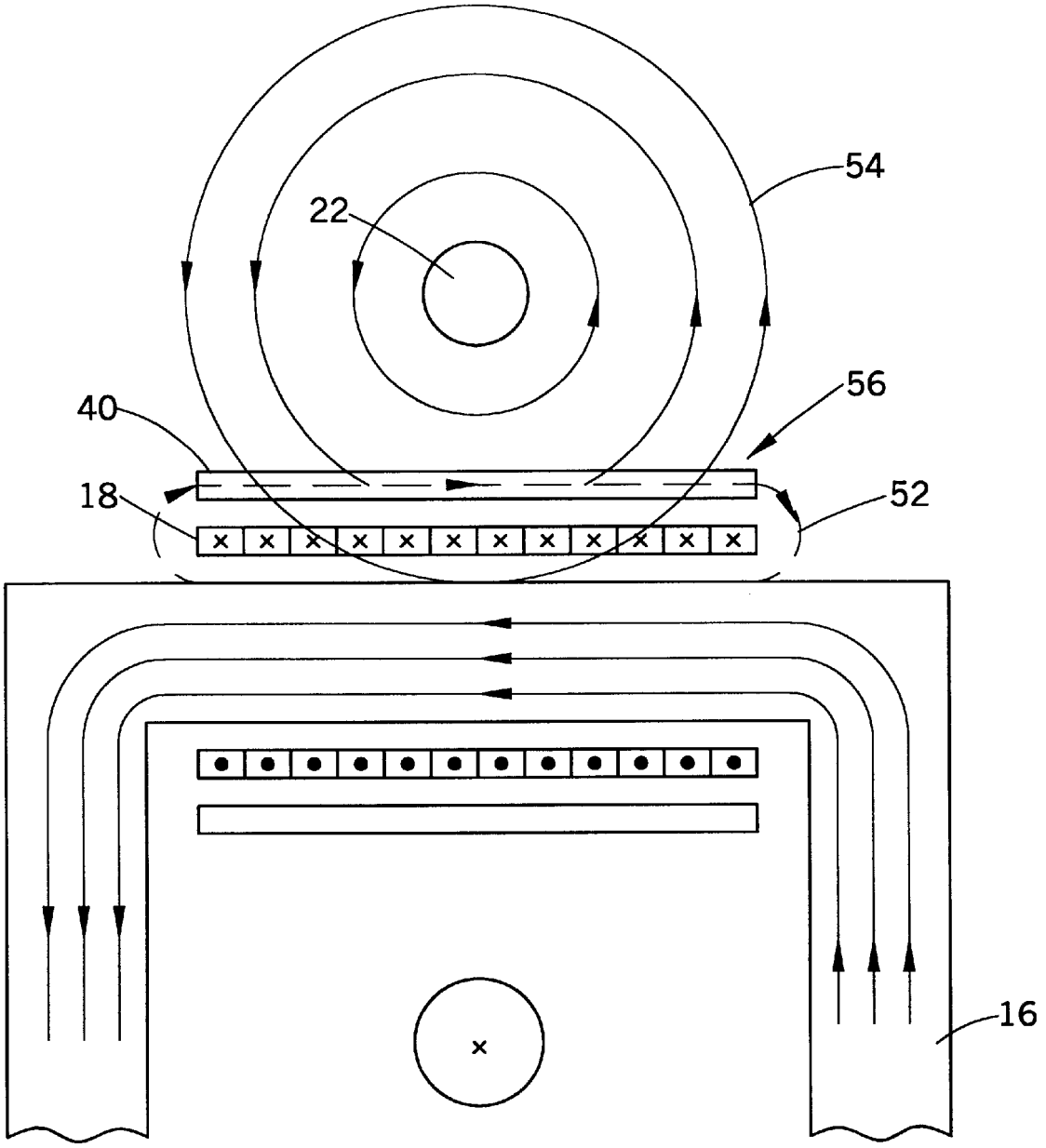
FIG.2 (PRIOR ART)
FIG. 2 is a schematic view in partial section for particularly illustrating flux patterns within portions of the conventional channel furnace of FIG. 1.

Referring now to the drawings wherein the showings are for illustrating the preferred embodiments of the invention only, and not for purposes of limiting the same, the FIGURES show a channel induction furnace including a uniquely configured bushing about the core and coil assembly of the furnace.

More specifically and with reference to FIG. 1, a general configuration of a channel furnace 10 is illustrated comprised of a tank portion 12 comprising the furnace hearth 13 for holding molten metal 14 inductively heated by a magnetic core 16 and coil 18 assembly, which in combination with yoke portions 20 essentially functions as a primary winding of a transformer. The metal 14 in the channels 21, 22, 23 is disposed in the form of metal loops surrounding the core and coil assembly and functions as a single turn secondary winding. When an alternating voltage is applied to the coil 18, flux is induced into the core 16 and yoke assemblies 20 for inducing a voltage, and therefore a current in the metal in the channels 21–23. The induced current causes the metal to heat, melt and remain molten. The molten metal circulates through the channels and into the hearth 13.

The configuration of the channels 21–23 is defined by a surrounding inductor refractory, e.g., concrete 24, and the hearth 13 is similarly enclosed in a hearth refractory 26. An outer metal casing 28 encases the assembly. Such a configuration for a channel furnace is well known within the art and is merely disclosed herein for exemplary purposes of better illustrating the environment for the novel bushing configuration about the coil 18.

Although FIG. 1 shows a common commercial configuration known as a twin-coil channel induction furnace, it will be appreciated that the invention is also applicable to a more simple single coil induction furnace.

The primary coils 18 are insulated from the molten metal in the channels 21–23 and hearth 13 by inner inductor refractories 30, 32 and bushings 40. It is, of course, the configuration of bushings 40 that is the principal subject of this invention.

Figure 4:
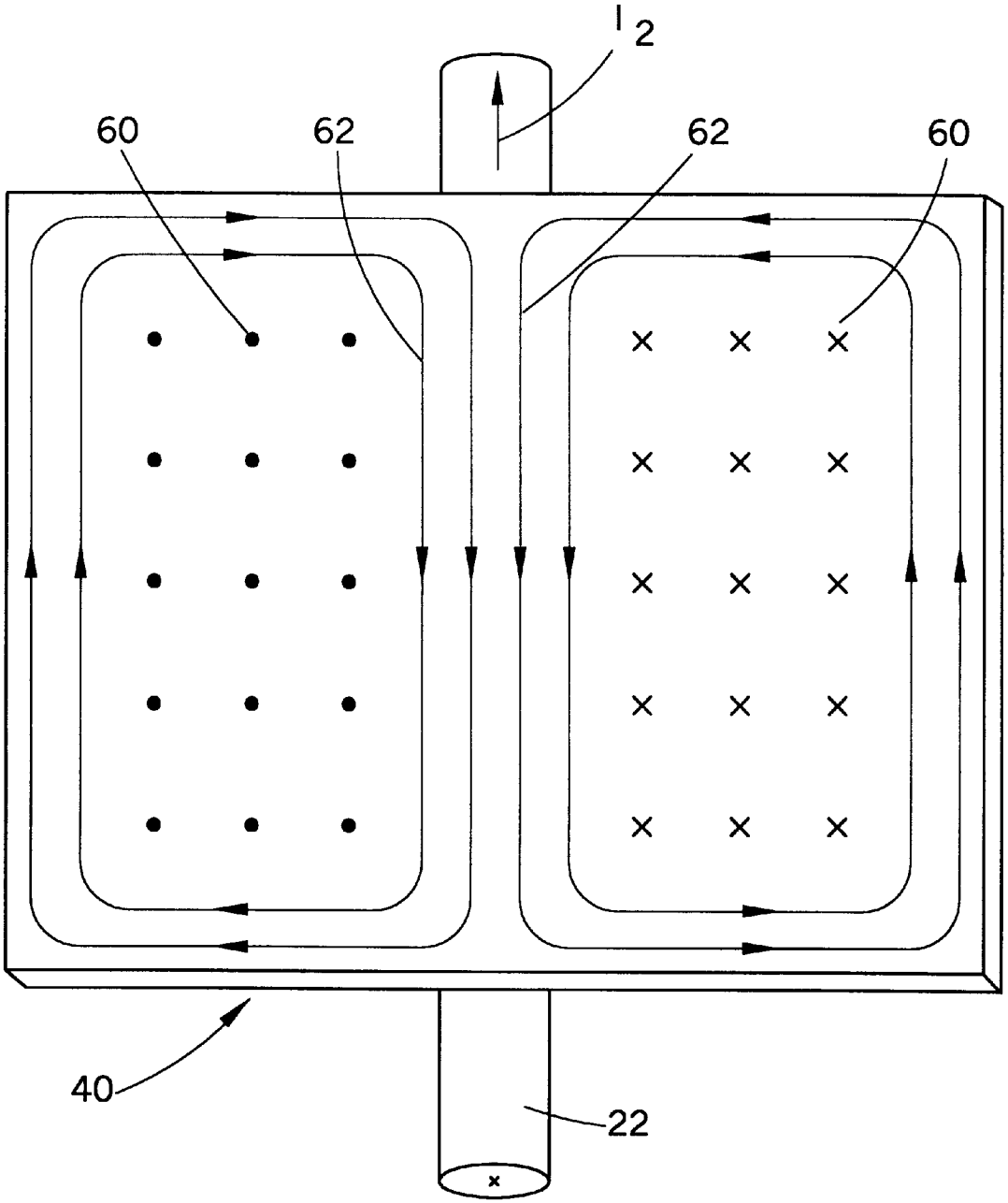
FIG.4 (PRIOR ART)
FIG. 4 is a diagrammatic, partial sectional view of the bushing relative to the channel for purposes of illustrating plate currents induced in the bushing.
Figure 5:
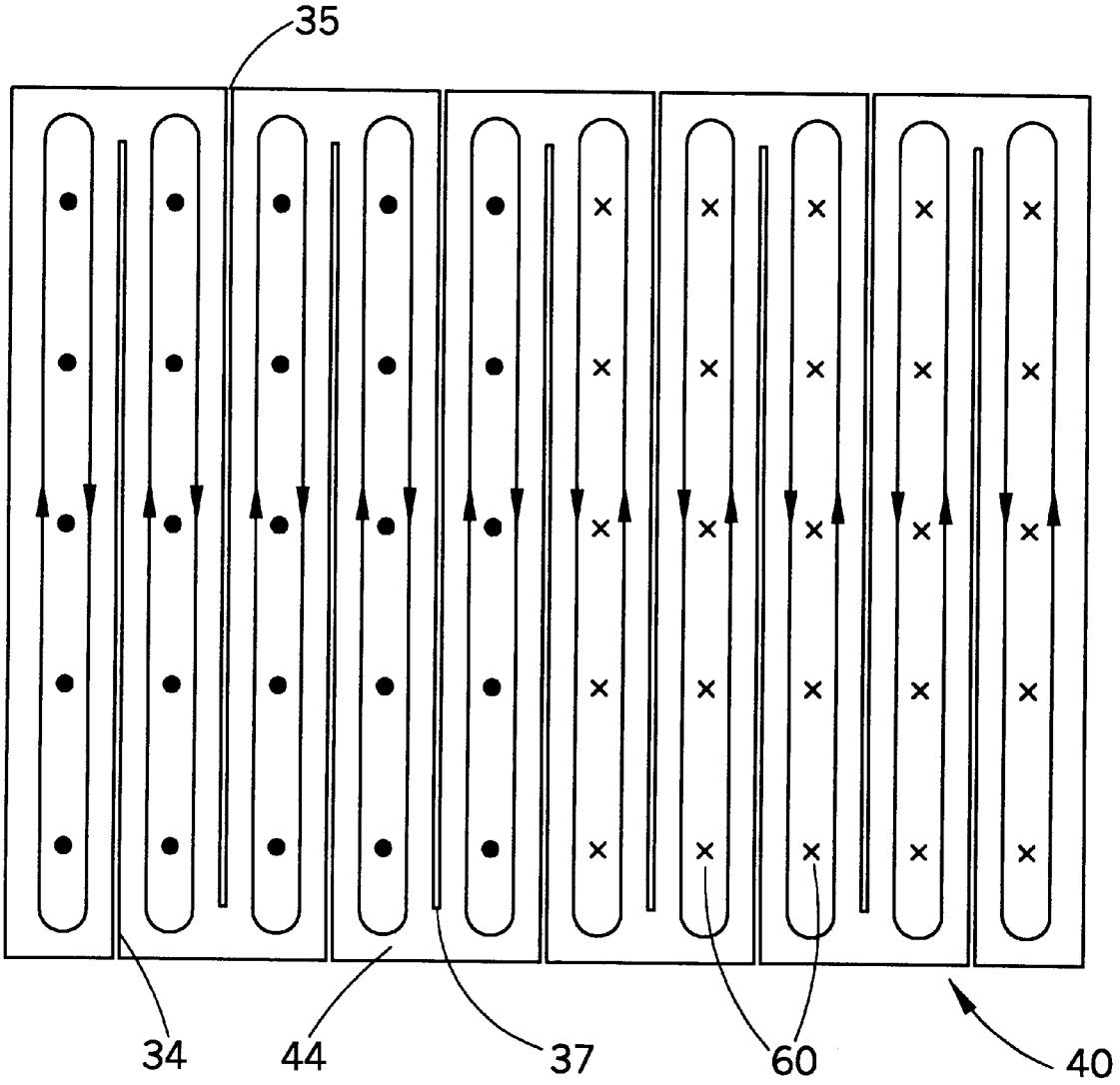
FIG. 5 is a partial sectional view of a bushing formed in accordance with the subject invention including a plurality of vertical slits.
Figure 6:
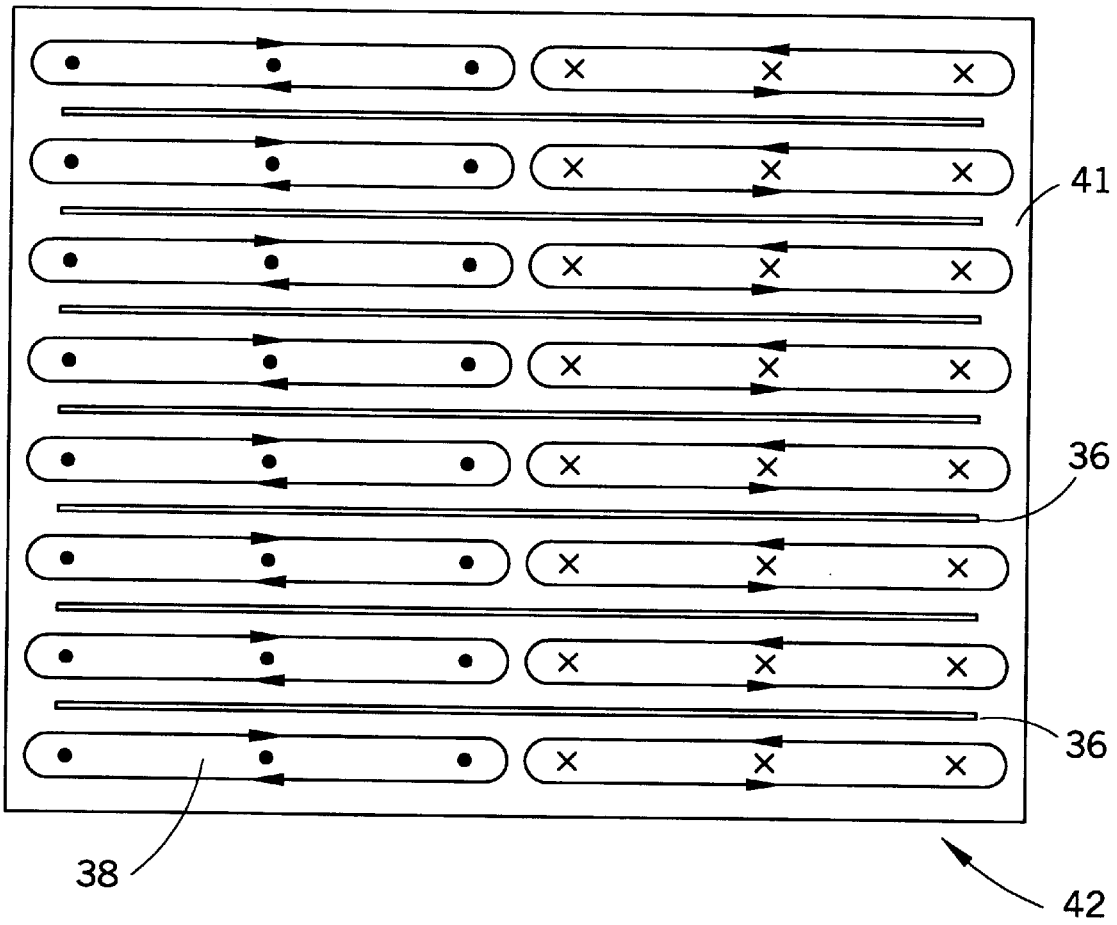
FIG. 6 is a partial sectional view of the bushing formed in accordance with the present invention wherein the bushing comprises a plurality of horizontal slits.

With particular reference to FIGS. 5 and 6, two alternative bushing configurations are shown. The the bushings 40 are configured to include a plurality of slits or gaps 34, 36 disposed in the walls 39, 41 of the bushing, for minimizing any current formation therein and correspondingly reducing power loss therefrom. In other words, the large double loop plate currents 62 shown in FIG. 4 cannot form since the walls of the bushing 40 are broken up into a plurality of wall portions spaced by the slits 34, 36.

More particularly, FIG. 5 shows the current pattern when the bushing is slit into many vertical strips 38. The slits 34 are disposed to extend circumferentially about the bushing for segregating the wall units into a plurality of wall sections. Each of the slits 34 has a first terminal end 35 extending through the edge of the wall 39 and a second terminal end 37 extending from the first terminal end 35 and spaced from the opposite edge of the wall 39 by a wall portion 44 for forming a series connection between adjacent wall sections. FIG. 6 shows the current pattern in the bushing 40 when it is slit into equal horizontally arranged strips 38 by slits 36 which are spaced from the edge of the bushing 40 by equal wall portions 41. Although the slits 36 cannot break the linkage between the bushing and the leakage fluxes, they do break a large plate current loop into many small ones. When the strip width is smaller than one penetration depth, the opposite currents will cancel each other. The smaller the strip width, the smaller the power loss.

It is noticed from FIGS. 5 and 6 that the slits do not have to be cut through at both ends to break the current loop. Certain connections are reserved to maintain the bushing as one piece. This kind of bushing is for air-cooled low power rating inductors.

For water-cooled high power inductors, instead of slitting a plate, tubes are used in the places of the strips. This replacement does not affect the currents, but it allows water-cooling from inside, i.e. opposite the refractory 24.

Figure 7:
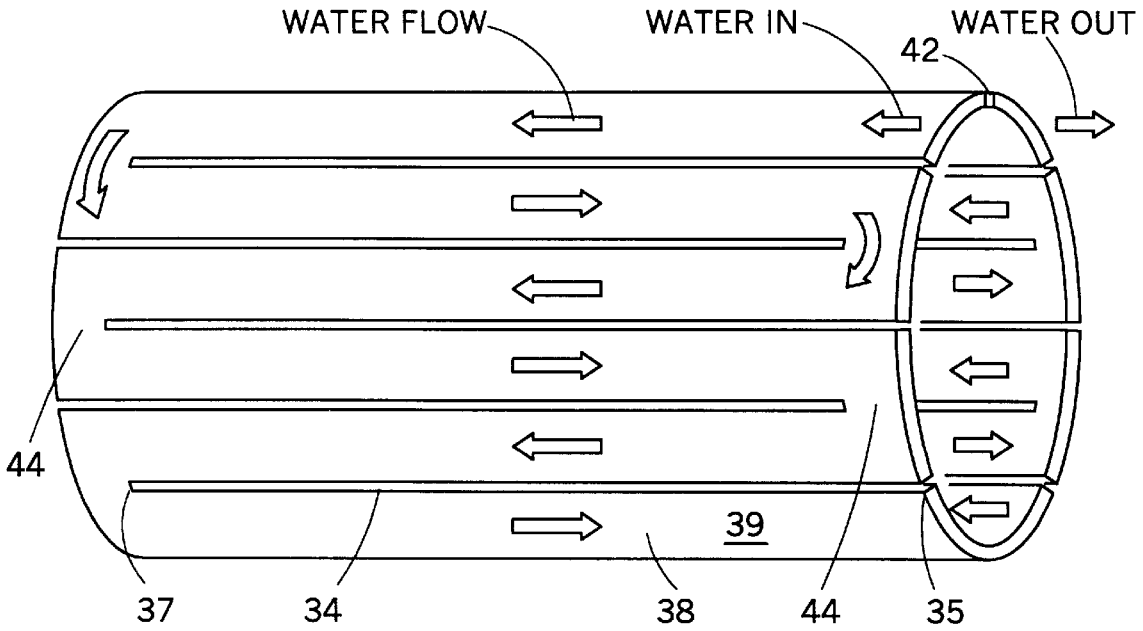
FIG. 7 is a perspective view of a coil bushing formed in accordance with the present invention.

FIG. 7 is the folded version of FIG. 5. Each strip 38 forms a single turn. When all the turns are connected in series, it becomes a coil and hence called a "coil bushing". Note that the series connection does not change the current in each turn.

Figure 8:
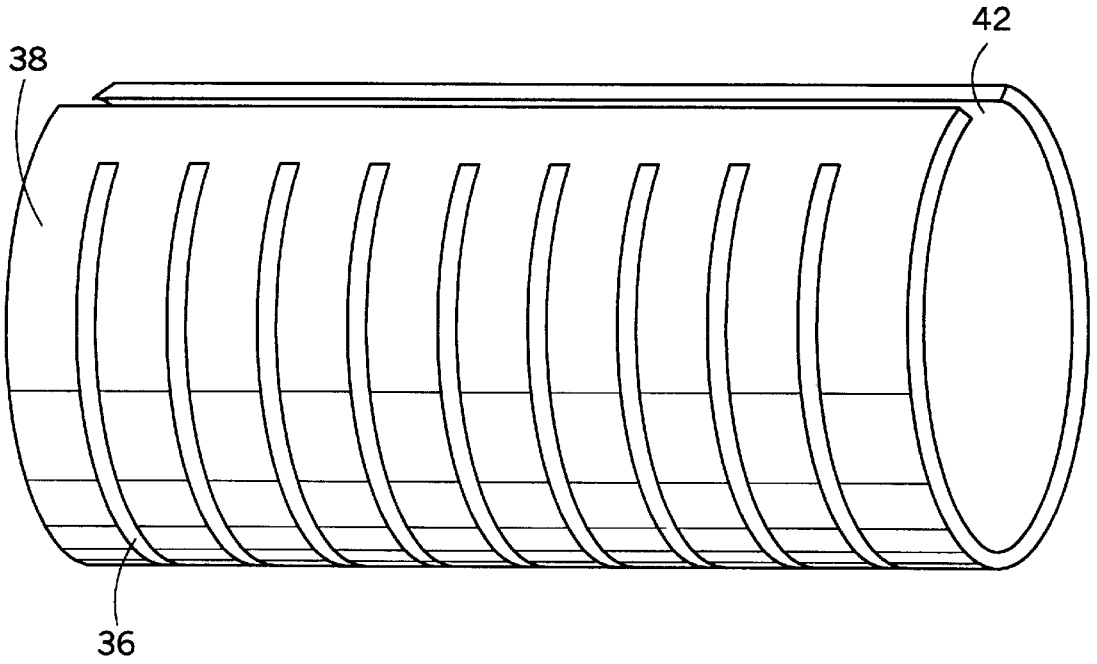
FIG. 8 is a cage bushing formed in accordance with the present invention.
Figure 3:
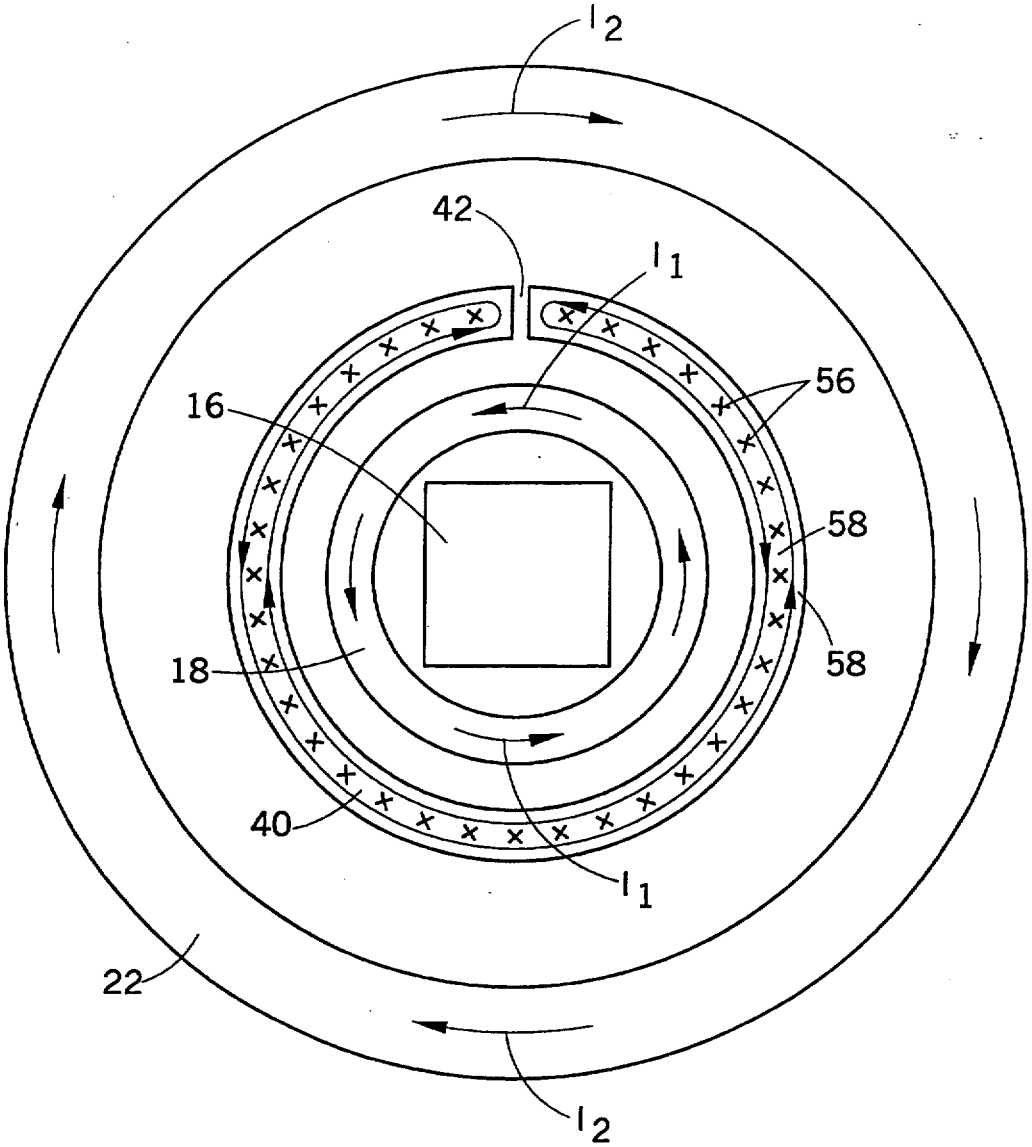
FIG.3 (PRIOR ART)
Figure 7:
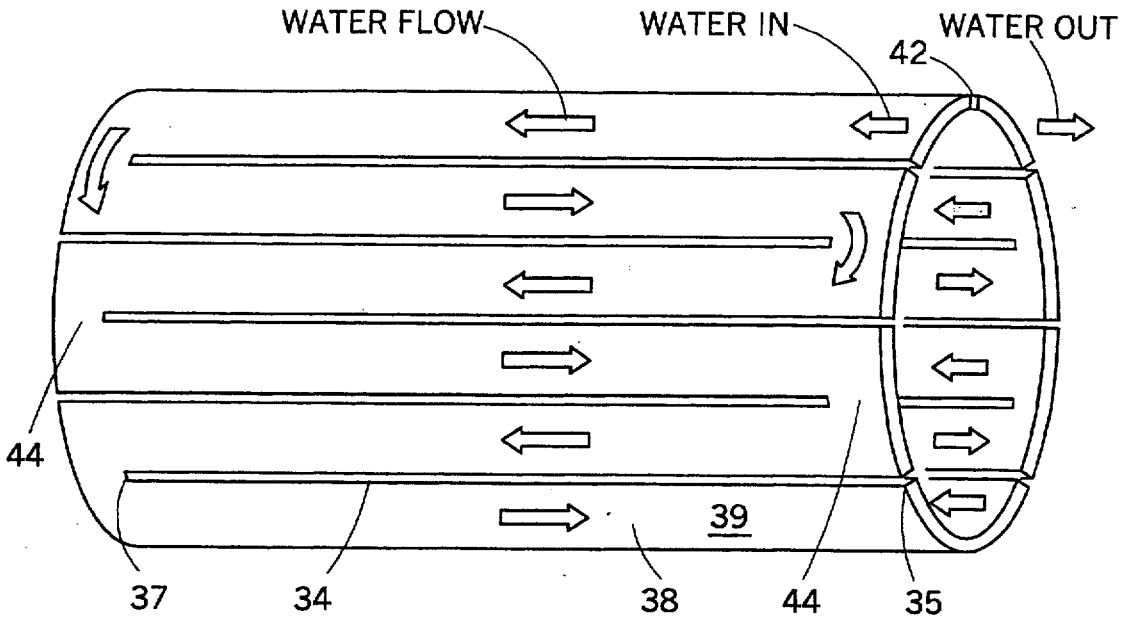
Figure 8:
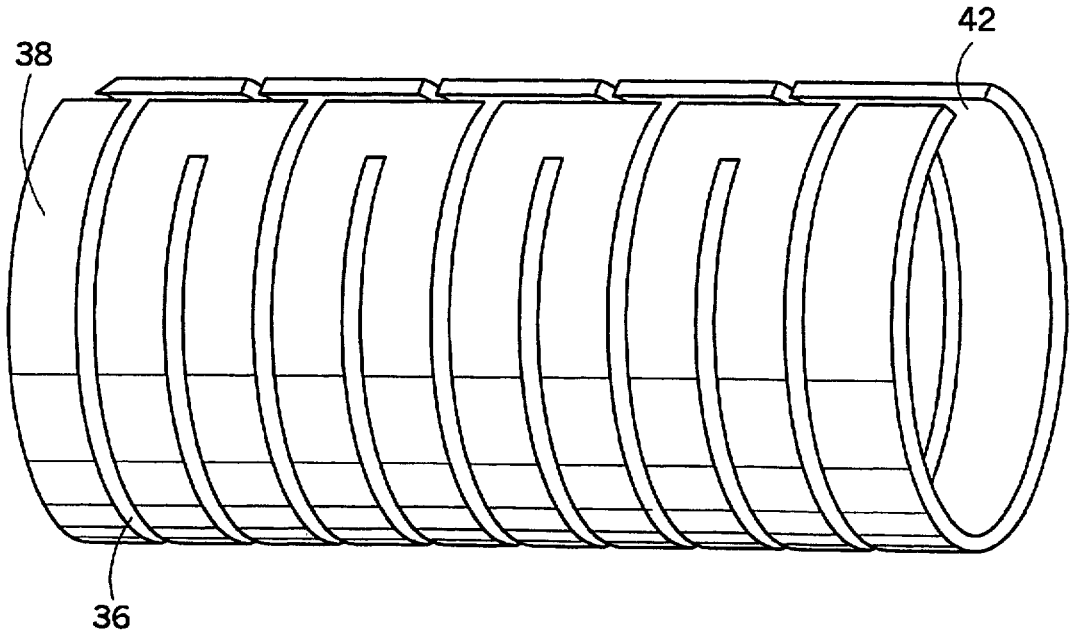

FIG. 8 is the folded version of FIG. 6. The ends of the tubes may be connected in any way according to water path as long as each end is not a closed ring. As the final shape of this bushing looks like a cage, it may be called a "cage bushing".

The disadvantage of the coil bushing is that a voltage is induced across its terminals. Although it is an open circuit, this voltage must be eliminated for personnel safety. This can be achieved by using either an anti-series connection (see FIG. 9) or an anti-parallel connection (see FIG. 10).

The cage bushing does not have the voltage problem, but it requires more connections at the ends.

In operation, if one were to consider a prior art bushing as merely a single turn coil bushing, it has been found that the subject invention as configured as a stainless steel bushing of 20 turns has a power loss which is ten to fifty times smaller than a single turn coil bushing, depending on the specific design.

The subject invention provides the advantageous operational results of avoiding the substantial change in conventional bushing configuration as far as support and separation of a refractory from a coil and core assembly is concerned, but yet provides a substantial reduction in power loss by effectively reconfiguring the bushing as a plurality of many narrow strips. Such bushing configurations are suitable for both air-cooled and water-cooled channel inductors.

Having thus described our invention, I now claim:

1. A bushing for an induction coil in a channel induction furnace comprising:

a wall having peripheral edges configured to insulate a coil and core assembly from the heat of the furnace, the wall having a gap extending a longitudinal extent between at least two of said edges thereof to preclude the bushing from functioning as a shorted secondary winding to the coil and core assembly; and a plurality of slits disposed in the wall, wherein each of said slits has at least one of its terminal ends spaced from the edge of said wall by a wall portion, for minimizing eddy current formation therein and correspondingly reducing power loss therefrom.

2. The bushing as described in claim 1 wherein the slits are disposed to extend circumferentially for segregating the wall into a plurality of wall sections, thereby forming a bushing assembly comprising a coil bushing.

3. The bushing as described in claim 2 wherein each of the slits has a first terminal end extending from one of said edges and a second terminal end spaced from other one of said edges by a wall portion for forming a series connection between adjacent wall sections.

4. The bushing as described in claim 2 wherein each wall section has a width smaller than one penetration depth.

5. The bushing as described in claim 1 wherein the wall comprises a conduit for conveying a cooling fluid for cooling of the bushing.

6. The bushing as described in claim 5 wherein each one of the wall sections comprises the conduit for water cooling of the bushing.

7. The bushing as described in claim 1 wherein the slits are disposed to extend longitudinally for segregating the wall into a plurality of wall sections, thereby forming a bushing assembly comprising a cage bushing.

8. The bushing as described in claim 7 wherein the bushing has first and second longitudinal terminal ends, said slits being spaced from one of said terminal ends by a wall portion for forming a series connection between adjacent wall sections.

9. The bushing as described in claim 8 wherein said series connection is disposed at alternating opposite ends of said terminal ends.

10. The bushing as described in claim 7 wherein each wall section is sized to accommodate equal and opposite eddy currents circulating therein.

11. The bushing as described in claim 1 wherein the slits are disposed to form a plurality of wall sections connected by wall portions forming anti-series connections therebetween.

12. The bushing as described in claim 1 wherein the slits are disposed to form a plurality of wall sections connected by wall portions forming anti-parallel connections therebetween.

13. A channel furnace for inductive heating of metals comprising:

a furnace hearth for holding of molten metal including a channel for circulating the molten metal to the hearth;

a core and coil assembly circumscribed by the channel and which induces a heating current in the metal in the channel, wherein the channel is separated from the core and coil assembly by a refractory insulator; and a bushing interposed between the refractory insulator and the core and coil assembly and including a wall gap to preclude the bushing from operating as a shorted secondary winding and further including at least one opening in a wall of the bushing for minimizing eddy current formation therein generated from leakage flux fields from the core and coil assembly.

14. The channel furnace as claimed in claim 13 wherein the opening is disposed to extend circumferentially about the bushing.

15. The channel furnace as claimed in claim 14 wherein the opening extends helically about the bushing.

16. The channel furnace as claimed in claim 13 wherein the opening comprises a plurality of slits extending partially about the wall to form a plurality of wall sections each sized to have a width smaller than one penetration depth.

17. The channel furnace as claimed in claim 16 wherein the wall sections a conduit to convey a cooling fluid therethrough.

18. The channel furnace as claimed in claim 16 wherein the wall sections are disposed to form an anti-series connection.

19. The channel furnace as claimed in claim 16 wherein the wall sections are disposed to form an anti-parallel connection.

20. The channel furnace as claimed in claim 13 wherein the opening is dispose to extend in parallel to the wall gap.

21. The channel furnace as claimed in claim 20 wherein the opening comprises a plurality of slits in the wall extending partially between terminal ends of the bushing.

22. The channel furnace as defined in claim 21 wherein the slits are disposed to form a plurality of wall sections.

23. The channel furnace as defined in claim 22 wherein the wall sections comprise a conduit for conveying a cooling fluid therethrough.

24. The channel furnace as defined in claim 13 wherein the channel is configured to form a double loop about the coil and core assembly.

* * * * *

UNITED STATES PATENT AND TRADEMARK OFFICE

CERTIFICATE OF CORRECTION

PATENT NO. : 5,953,363
DATED : September 14, 1999
INVENTOR(S) : Maochang Cao

It is certified that error appears in the above-identified patent and that said Letters Patent is hereby corrected as shown below:

Title page, "7 Drawing Sheets" should read --8 Drawing Sheets--.

Column 2, line 3, in the equation, delete "π" and insert --ρ-- therefor.

Column 2, line 7, after "depth", insert --(inch)-- therefor.

Column 2, line 8, after "resistivity", insert --(Ω - inch)-- therefor.

Figure 3:
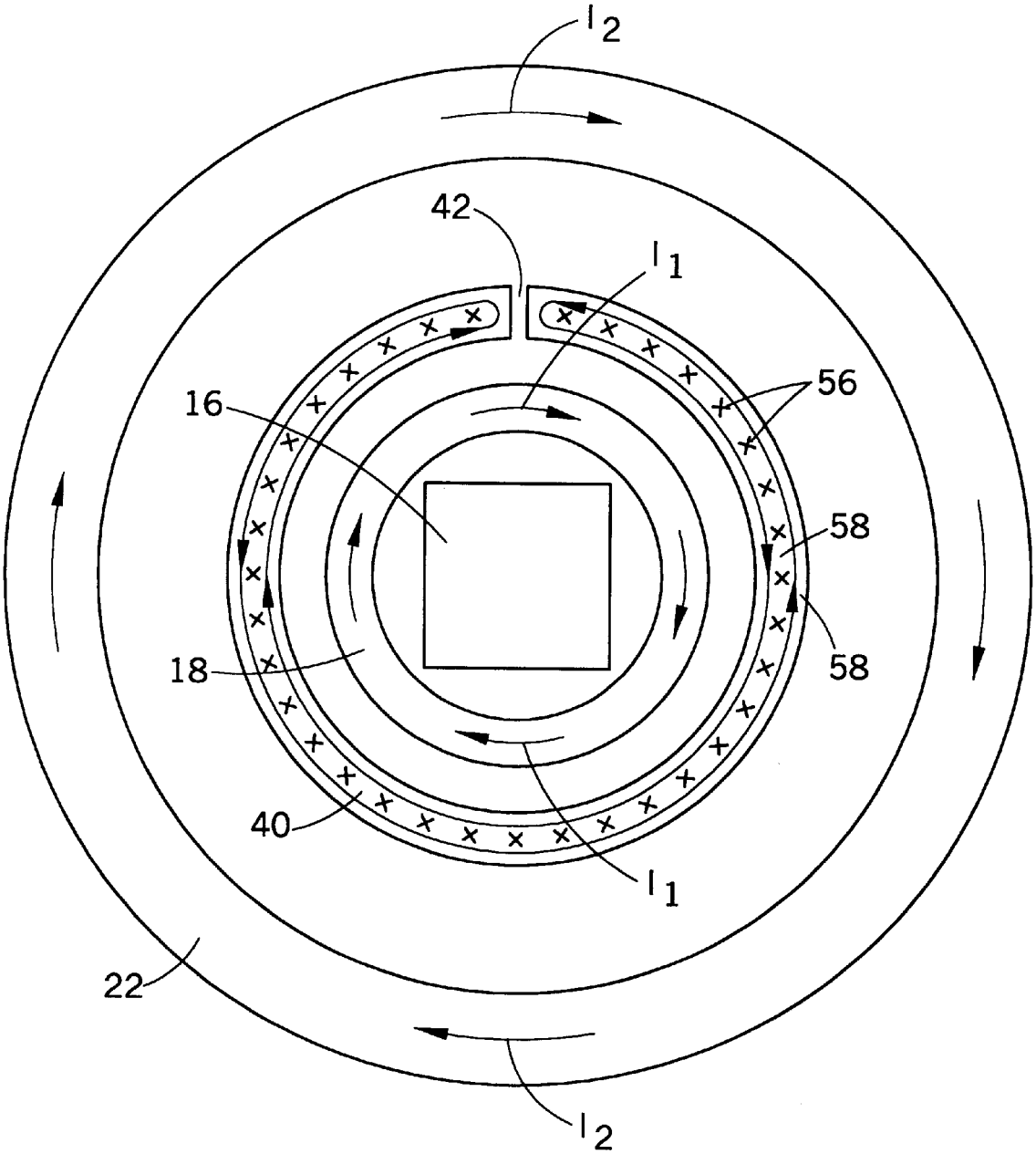
FIG.3 (PRIOR ART)
FIG. 3 is a partial diagrammatic, partial sectional view, rotated 90° from the view of FIG. 2, particularly illustrating layer currents induced in the bushing by a longitudinal flux.

Replace Figure 3 with attached new Figure 3.

Replace Figure 8 with attached new Figure 8.

Figure 9:
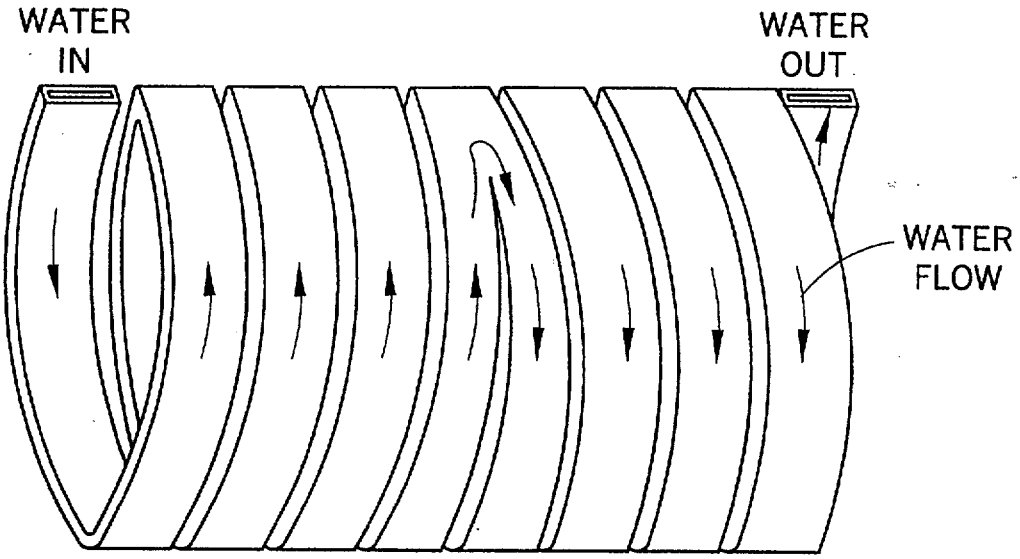
FIG. 9 comprises a water-cooled coil bushing including an anti-series connection therein; and, FIG. 10 shows a water-cooled coil bushing including an anti-parallel connection therein.
Figure 10:
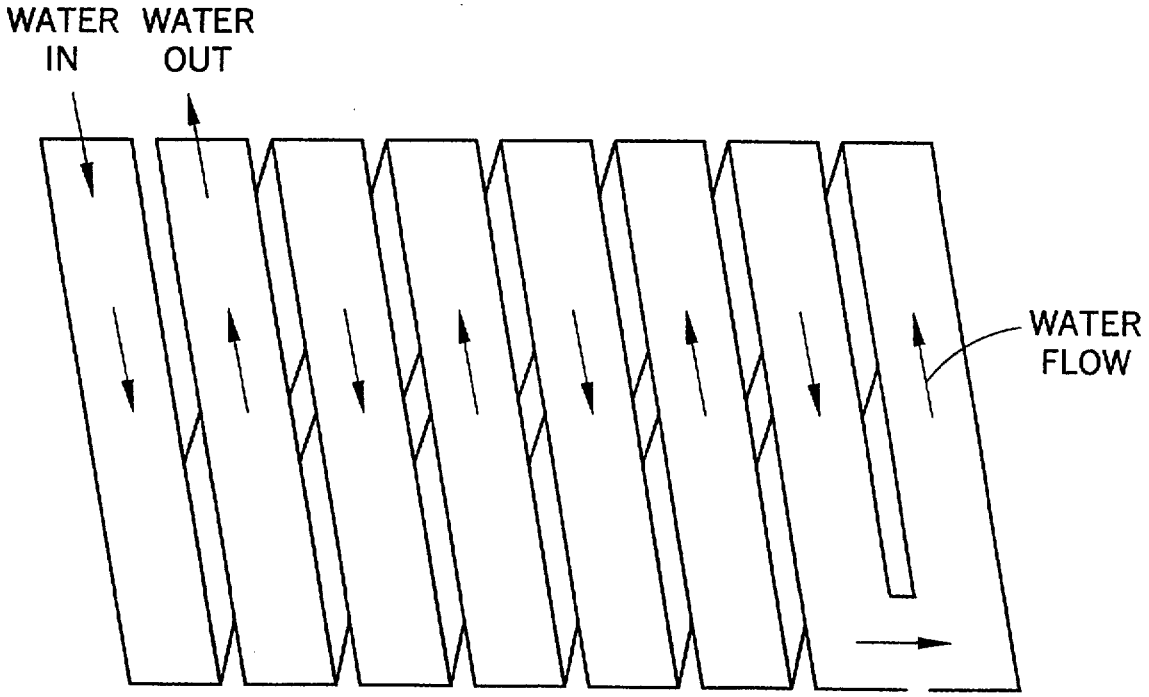

Add attached Figures 9 and 10.

Signed and Sealed this

Twenty-second Day of August, 2000

*Attest:*

Q. TODD DICKINSON

*Attesting Officer*

*Director of Patents and Trademarks*